United States Patent [19]

Clipson et al.

[11] 3,995,385

[45] Dec. 7, 1976

[54] STORAGE BIN WITH CARD HOLDER

[75] Inventors: Stuart A. Clipson, Glendale; Theodore J. Day, Cincinnati, both of Ohio

[73] Assignee: Midland-Ross Corporation, Cleveland, Ohio

[22] Filed: May 23, 1975

[21] Appl. No.: 580,131

[52] U.S. Cl. ..... 40/10 R; 40/324

[51] Int. Cl.[2] ..... G09F 3/18

[58] Field of Search ..... 40/10, 16, 325, 324

[56] References Cited

UNITED STATES PATENTS

| | | | |
|---|---|---|---|
| 605,213 | 6/1898 | Weller | 40/310 |
| 1,247,033 | 11/1917 | Swartz | 40/16 R X |
| 2,535,575 | 12/1950 | Hodges | 40/10 A X |
| 2,908,985 | 10/1959 | Hartman | 40/324 |
| 3,163,319 | 12/1964 | Mauser | 206/509 |
| 3,347,394 | 10/1967 | Gould | 211/126 |

*Primary Examiner*—Louis G. Mancene
*Assistant Examiner*—Wenceslao J. Contreras
*Attorney, Agent, or Firm*—H. Duane Switzer

[57] ABSTRACT

A storage bin includes a downwardly and outwardly inclined front handle having a flat outer surface with a card retaining pocket for retaining the edges of a flat rectangular identification card which is positioned against the handle outer surface.

2 Claims, 6 Drawing Figures

STORAGE BIN WITH CARD HOLDER

BACKGROUND OF THE INVENTION

This application relates to the art of storage bins and, more particularly, to storage bins having identification card retainers thereon.

Storage bins of known types include those disclosed in U.S. Pat. Nos. 3,163,319 issued Dec. 29, 1964, to Mauser and 3,347,394 issued Oct. 17, 1967, to Gould. Such storage bins are commonly vertically stacked upon one another, or suspended on a frame in vertical tiers. The bins are commonly used to hold parts of different types and sizes, and it is common to provide an indicating card having writing or other indicia thereon to indicate the size or type of part contained within each bin.

In a bin of the type disclosed in the Gould patent, there is no card retaining pocket and it would be necessary to write directly on the bin handle itself or to adhesively secure an indicating card thereto. This makes it difficult to replace and change the indicating card or indicia.

In a bin of the type disclosed in the Mauser patent, a card receiving pocket is provided on the front handle of the bin. However, such pocket is positioned exactly vertical or is inclined inwardly and when such bins are stacked vertically on top of one another, or are suspended in vertical tiers from a frame, it is very difficult for a standing person to read the indicating cards on the lowermost bins.

SUMMARY OF THE INVENTION

A storage bin includes a downwardly and outwardly inclined front handle having a flat outer surface intersecting a vertical plane at an included acute angle substantially less than 90°. A card retaining pocket on the outer surface of the handle retains the edges of a flat rectangular card which is positioned against the handle outer surface.

In a preferred arrangement, the card retainer is defined by a generally U-shaped member which is separate from the bin and handle. The generally U-shaped member has a wall extending outwardly from the handle outer surface, and a flange extends inwardly from the outer edge of the wall in outwardly-spaced overlying relationship to the handle outer surface for defining a groove which receives the edges of a card. The bottom edge of the wall is bonded to the handle outer surface.

In accordance with one aspect of the invention, the handle outer surface has alignment edges extending outwardly therefrom in inwardly-spaced relationship to the handle outer edges. The inner surface of the wall on the card retainer is positioned against the alignment edges for centrally locating the card retainer on the outer surface of the handle while it is bonded thereto.

The card retainer may be bonded to the outer surface of the handle by the use of adhesive or solvent, but in a preferred arrangement it is bonded thereto by sonic welding.

In one arrangement, the alignment edges on the outer surface of the handle are defined by the edges of a rectangular area which is raised outwardly from the outer surface of the handle. The rectangular area actually defines an outwardly stepped handle outer surface area, and the edges of such outwardly-spaced area are abutted by the inner surface of the wall on the card retainer. The wall has a height substantially greater than the distance the rectangular area is raised outwardly from the handle outer surface in order that the inner surface of the flange will be spaced outwardly from the rectangular area to define the groove.

The groove which receives the edges of the identification card preferably opens upwardly adjacent the top edge of the handle so that a card is slidable downwardly against the outer surface of the handle while its opposite side edges are received in the grooves.

The flat outer surface of the handle is preferably inclined to the vertical at an included acute angle between 10° and 30°, and most preferably at approximately 20°.

With an arrangement of the type described, the identification cards on all of the bins, when they are vertically stacked or tiered from a frame, are easily visible and readable by a standing person so he can readily locate the bin containing the desired parts without having to stoop or bend over.

DESCRIPTION OF A PREFERRED EMBODIMENT

Figure 1:
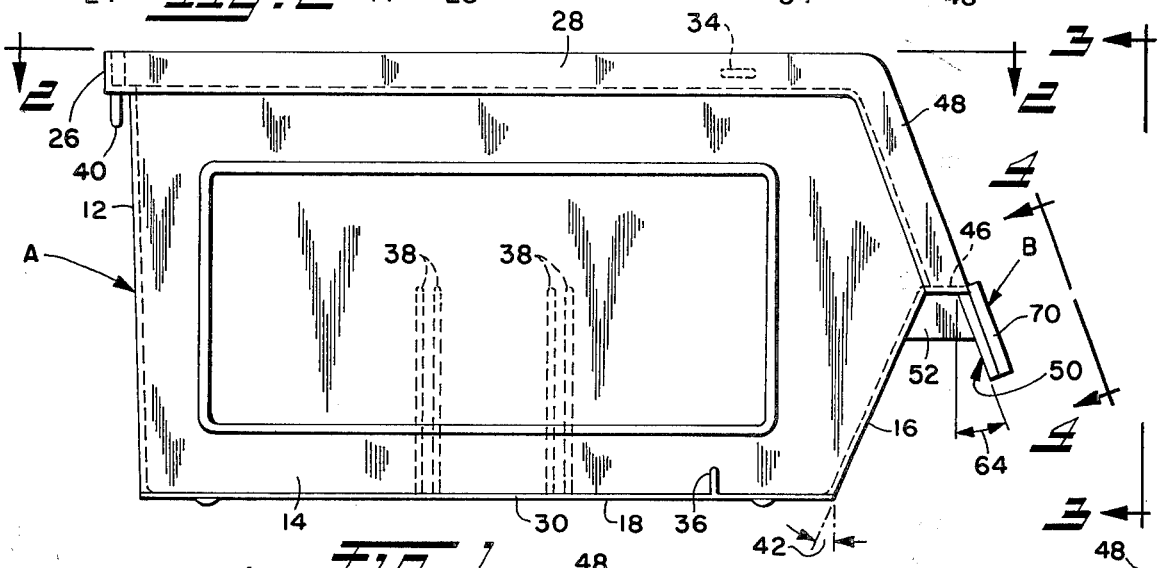
FIG. 1 is a side elevational view of a bin having the card retainer of the present invention incorporated therein.
Figure 3:
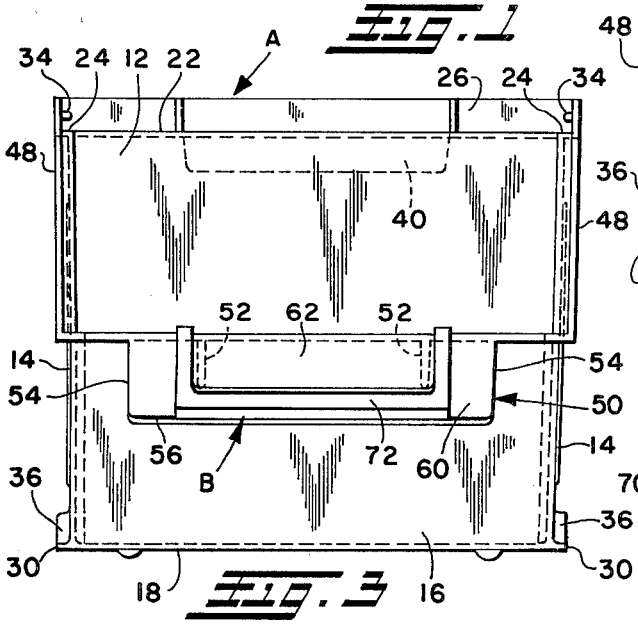
FIG. 3 is a front elevational view looking generally in the direction of arrows 3—3 of FIG. 1.
Figure 4:
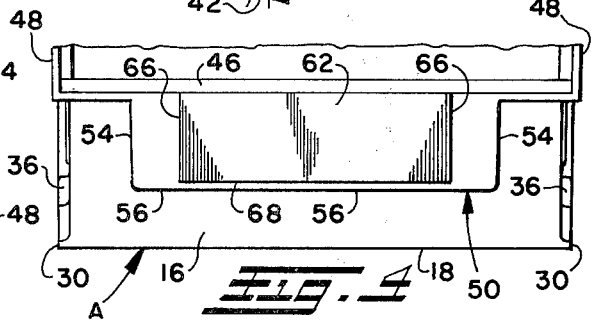
FIG. 4 is an elevational view looking generally in the direction of arrows 4—4 of FIG. 1, and with the card retainer removed to show the outer surface of the handle.
Figure 5:
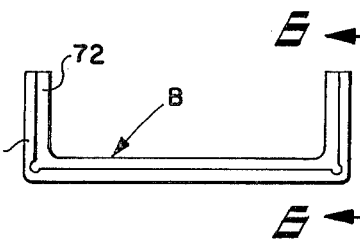
FIG. 5 is a rear view of the card retainer before it is bonded to the bin handle.
Figure 6:
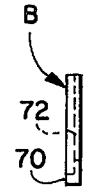
FIG. 6 is a side elevational view looking generally in the direction of arrows 6—6 of FIG. 5.

Referring now to the drawing, wherein the showings are for purposes of illustrating a preferred embodiment of the invention only and not for purposes of limiting same, FIG. 1 shows a storage bin A which is preferably molded in one-piece of any suitable plastic material. Bin A includes a rear wall 12, opposite sidewalls 14 and a front wall 16, all extending upwardly from a bottom wall 18.

A single draft angle of at least one degree is provided so that walls 12 and 14 slope outwardly as shown in the drawing. Adjacent their upper ends, walls 12 and 14 are stepped outwardly to provide shoulders 22 and 24 having terminal wall portions 26 and 28 extending upwardly therefrom. The opposite bottom side edges of bin A have outwardly extending flanges 30 supportable on shoulders 24, and the rear bottom edge of bin A is supportable on shoulder 22. Abutments 34 extend inwardly from terminal sidewall portions 28 for cooperation with outwardly extending stop abutments 36 adjacent bottom wall 18 of bin A for preventing outward sliding movement of an upper bin stacked upon a lower bin. Vertical ribs 38 on the inner surfaces of sidewalls 14 are provided for receiving rectangular dividers for dividing bin A into a plurality of compartments. A downwardly extending hook 40 under rear shoulder 22 is provided for suspending bin A on a frame.

As best shown in FIG. 1, front wall 16 slopes outwardly at an included angle 42 to the vertical of approximately 25°. Such front wall 16 also extends upwardly a substantially smaller distance than rear wall 12 and sidewalls 14, and in the arrangement shown, such front wall 16 is approximately one-half the height of the rear and sidewalls. A shelf portion 46 extends horizontally outward from the upper edge of front wall 16 and its opposite side edges are integrally connected with downwardly inclined portions 48 of terminal sidewall portions 28.

A generally rectangular flat handle 50 extends downwardly and outwardly from shelf portion 46. Spaced-apart reinforcing ribs 52 extend integrally between front wall 16 and the undersurface of handle 50 for reinforcing handle 50 against bending or breaking.

Handle 50 has opposite side edges 54 spaced a substantial distance inwardly from sidewalls 14, and a bottom edge 56 spaced a substantial distance above bottom wall 18. Handle 50 includes a substantially flat and plane outer surface 60 which includes an outwardly raised rectangular area 62. Such flat outer surface of handle 50 extends at an included angle 64 to the vertical between 10° and 30°, and preferably approximately 20°. Outwardly raised rectangular area 62 has opposite side edges 66 spaced inwardly from handle side edges 54, and a bottom edge 68 spaced inwardly from handle bottom edge 56. Such edges 66 and 68 define alignment edges which are abutted by a card retaining member while such member is bonded to the handle outer surface.

Figure 2:
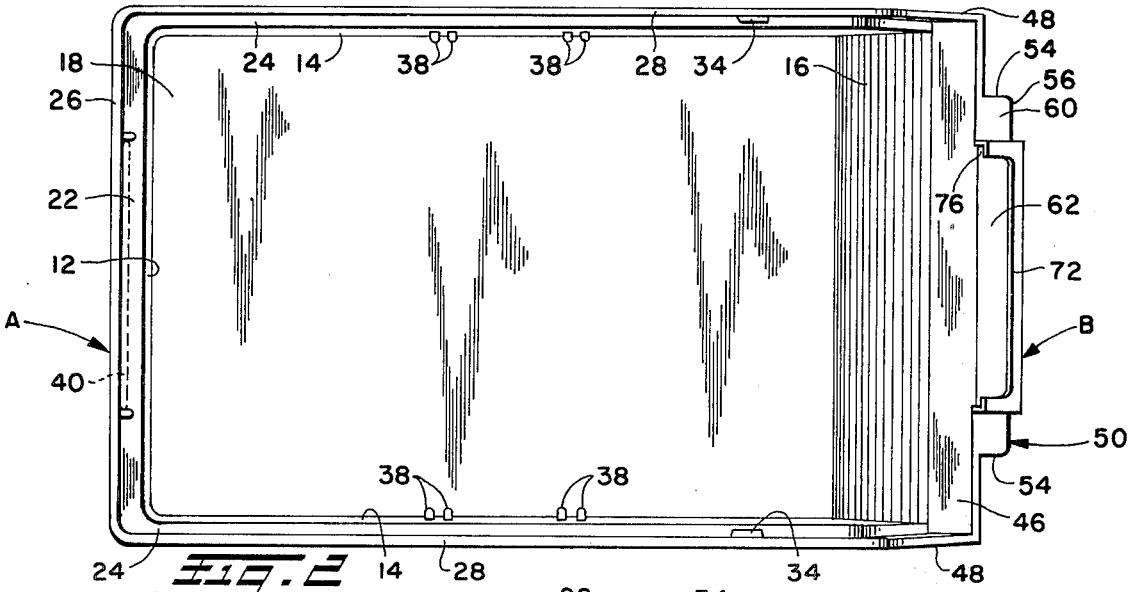
FIG. 2 is a top plan view looking generally in the direction of arrows 2—2 of FIG. 1.

A generally U-shaped card retaining member B has a peripheral wall 70 and a peripheral flange 72 extending inwardly from the outer edge thereof. Wall 70 has a height greater than the distance area 62 is raised outwardly from outer surface 60 so that the undersurface of flange 72 will be spaced outwardly from surface area 62 when the bottom edge of wall 70 is positioned against handle outer surface 60 to define a groove shown generally at 76 in FIG. 2. Retaining member B is shaped and dimensioned so that the inner surface of wall 70 abuts alignment edges 66 and 68 for centrally locating retaining member B on handle 50 while it is bonded thereto. Retaining member B may be bonded to handle 50 by the use of adhesive or solvent, and in a preferred arrangement is sonically welded thereto.

Flange 72 extends inwardly a very short distance so that substantially all of area 62 is open, and groove 76 has a depth parallel to surface area 62 just sufficient to hold the opposite side and bottom edges of a generally rectangular identification card. Groove 76 opens upwardly adjacent the upper edge of handle 50 and shelf 46 so that a generally rectangular flat identification card is slidable downwardly against surface area 62 with its opposite side edges received in groove 76. Groove 76 provided by card retaining member B defines a card retaining pocket which receives and retains the edges of a generally rectangular flat identification card for easy viewing by a standing person when a plurality of bins A are vertically stacked upon one another or suspended in vertical tiers from an upstanding frame.

Terminal sidewall portions 48 are inclined downwardly at substantially the same angle as handle 50, and a front opening is defined for bin A between such terminal sidewall portions 48 and shelf portion 46. It is very simple to provide suitable indicia on a generally rectangular flat identification card and to then position such card against handle outer surface area 62, with the opposite side and bottom edges of such card being firmly retained beneath flange 72 of card retaining member B. It is very easy to change or replace such card simply by sliding it upwardly along surface area 62.

Although the invention has been shown and described with reference to a preferred embodiment, it is obvious that equivalent alterations and modifications will occur to others skilled in the art upon the reading and understanding of this specification. The present invention includes all such equivalent alterations and modifications, and is limited only by the scope of the claims.

We claim:

1. A storage bin including a downwardly inclined substantially flat front handle intersecting a vertical plane at its top edge at an included acute angle substantially less than ninety degrees, said handle having an outer surface including a generally rectangular area raised outwardly therefrom, said rectangular area including a bottom alignment edge and opposite side alignment edges respectively spaced inwardly from the bottom and opposite side edges of said handle, a card retaining pocket on said outer surface for retaining the side and bottom edges of a flat card which is positionable against said outer surface, said pocket being defined by a generally U-shaped member including a wall having an inner surface abutting said alignment edges and being bonded to said outer surface, said wall having a height greater than the distance said rectangular area is raised outwardly from said outer surface, an integral flange on said generally U-shaped member extending inwardly from the outer edge of said wall in outwardly spaced relationship to said generally rectangular area to define a peripheral groove which is upwardly open adjacent the top edge of said handle.

2. A storage bin having a bottom and an open top, a downwardly inclined substantially flat front handle on said bin located intermediate said top and bottom, said handle having a substantially flat outer surface inclined to the vertical at an included acute angle substantially less than ninety degrees, a card retainer on said outer surface for retaining the edges of a generally rectangular card which is positioned against said outer surface, said card retainer comprising a retaining member bonded to said outer surface and having a flange extending in outwardly-spaced overlying relationship to said outer surface and defining opposed spaced-apart parallel grooves for receiving opposite edges of a generally rectangular card, said outer surface including alignment edges extending outwardly therefrom in inwardly-spaced relationship to the outer edges of said handle, and said card retainer being in engagement with said alignment edges for centrally locating said card retainer on said outer surface.

* * * * *